US005151211A

United States Patent [19]

Brooks et al.

[11] Patent Number: 5,151,211

[45] Date of Patent: Sep. 29, 1992

[54] OIL BLEACHING METHOD AND COMPOSITION FOR SAME

[75] Inventors: David D. Brooks, Crystal Lake; Shirley A. Brophy, Ingleside; George R. Goss, Quincy, all of Ill.

[73] Assignee: Oil-Dri Corporation of America, Chicago, Ill.

[21] Appl. No.: 679,265

[22] Filed: Apr. 2, 1991

Related U.S. Application Data

[62] Division of Ser. No. 280,127, Dec. 5, 1988, Pat. No. 5,004,570.

[51] Int. Cl.[5] ..... C11B 3/00

[52] U.S. Cl. ..... 252/186.1; 426/253; 554/191

[58] Field of Search ..... 252/186.1; 260/420, 260/424, 427, 428; 426/254, 255, 417

[56] References Cited

U.S. PATENT DOCUMENTS

| | | | |
|---|---|---|---|
| 3,036,102 | 5/1962 | Pons | 260/420 |
| 3,673,228 | 6/1972 | Harris et al. | 260/428 |
| 3,678,084 | 7/1972 | Renold | 260/424 |
| 3,955,004 | 5/1976 | Strauss et al. | 426/254 |
| 4,230,630 | 10/1980 | Mag et al. | 260/420 |
| 4,443,379 | 4/1984 | Taylor et al. | 260/427 |
| 4,734,226 | 3/1988 | Parker et al. | 260/420 |
| 4,781,864 | 11/1988 | Pryor et al. | 260/420 |
| 5,004,570 | 4/1991 | Brooks et al. | 260/427 |

*Primary Examiner*—Richard D. Lovering
*Assistant Examiner*—Joseph D. Anthony
*Attorney, Agent, or Firm*—Dressler, Goldsmith, Shore, Sutker & Milnamow, Ltd.

[57] ABSTRACT

The present invention contemplates a method for treating oils having undesirable color impurities and an oil bleaching composition suitable for use in this method. The method comprises contacting the oil with the oil bleaching composition for a time period sufficient to reduce the amount of color impurities of the oil. The oil bleaching composition includes a neutral bleaching clay and a chelating polycarboxylic acid. The spent bleaching composition resists spontaneous combustion.

6 Claims, 1 Drawing Sheet

OIL BLEACHING METHOD AND COMPOSITION FOR SAME

This application is a division of application Ser. No. 07/280,127, filed Dec. 5, 1988, now U.S. Pat. No. 5,004,570.

TECHNICAL FILED

This invention relates to the bleaching of oil. In particular, the present invention is directed to a method for removing color impurities from oil using a neutral bleaching clay and a chelating polycarboxylic acid. The spent bleaching composition resists spontaneous combustion.

BACKGROUND OF THE INVENTION

Fats and fatty oils, commonly called triglycerides, consist primarily of triesters of glycerol, and include minor amounts of fatty acids. At ambient temperatures, about 20° to about 25° C., fats are solids whereas fatty oils are liquids.

Fats and fatty oils are widely distributed in nature. Many are derived directly from vegetable, animal, and marine sources. Others are obtained, as by-products, in the production of fiber from vegetable matter, and in the production of protein from vegetable, animal or marine matter.

A vast majority of vegetable and animal-derived fats are made up of fatty-acid molecules containing more than about 8 carbon atoms. Marine-derived fats, however, are characterized by their relatively longer-chain fatty acids that may contain up to about 24 carbon atoms.

Throughout this application, the term "oil", and grammatical variations thereof, includes vegetable-derived, animal-derived and marine source-derived fats and fatty oils that are liquids at the particular temperature that is necessary for desired processing of a particular type of oil.

Illustrative sources of edible vegetable oil include canola, coconuts, corn germ, cottonseed, olives, palms, peanuts, rapeseed, safflower, sesame seeds, soybeans, and sunflowers. Examples of nonedible vegetable oils are jojoba oil, linseed oil and castor oil.

Illustrative sources of edible animal-derived oil include lard and tallow. Examples of a nonedible animal-derived oil are low grade tallow and neat's-foot oils.

Some of these oils may have a color that is objectionable to a consumer. Thus, the oil needs to be bleached to improve its color quality. To this end, a great many oils are commonly treated with bleaching clays to reduce oil color values. Bleaching clays generally improve oil color quality by adsorbing color impurities that are present in the oil. Color impurities typically present in oils include, for example, carotenes, xanthophylls, carotenoid acids, xanthophyll esters, chlorophyll, tocopherols and oxidized fatty acids and fatty acid polymers.

It is desirable to remove color impurities from oil not only prior to use but also after use, thereby enabling re-using or recycling the oil. For example, in recent years there has been a substantial growth in the "fast food" type of restaurant. A number of these restaurants specialize in cooking and serving a variety of fried foods which have been prepared in edible cooking oils. Such oils degrade during use and can become noticeably discolored depending upon the nature of the cooking operation, the cooking temperature, and other food-preparing conditions to which such oils have been subjected. The used oil, now discolored, may impart an objectionable color to the food as well. Such color, while not harmful in itself, is often interpreted by the consumer as an indication that the food is substandard or otherwise undesirable. The now discolored oil may therefore be deemed unacceptable for its intended purpose. However, renderers of waste oils commonly remove the color impurities from undesirable oils by bleaching the oil of color impurities to produce a marketable oil.

It is also desirable to remove color impurities from nonedible oil to obtain a desirable color.

Natural clays, e.g., Fuller's earth and bentonite, have commonly been used as bleaching clays to remove both the naturally-occurring and the otherwise-present, e.g., the thermally-induced, color impurities from edible and nonedible oils. It has been suggested that clays containing zeolite can also be used for such a purpose.

Unfortunately, these commercially available natural clays used to remove color impurities from oils remove only the red and yellow color impurities, leaving behind other undesirable color impurities such as chlorophyll. Additionally, these natural clays remove color impurities at the expense of oil filterability. That is, it often becomes necessary to reduce the filtration rate through the clay to achieve such a result. Reduction of oil-filtration rates may involve increased capital expense to maintain current oil-production levels.

An alternative is the use of acid-activated clays. While acid-activated clays remove a wider spectrum of color impurities, their acidity creates other problems such as reduced filter cloth life and the like. These acid-activated clays, which have a pH value of 2 to 5, are more expensive than neutral clays, which have a pH value of about 5 to about 9. Furthermore, acid-activated clays have high residual acid levels which is undesirable. Acid-activated clays may also increase the free fatty acid (FFA) content of the oil.

Bleaching clays are usually not equally efficient at removing color impurities from different oils. Furthermore, there are seasonal variations in the content of color impurities in many vegetable oils. For these reasons, processors of oils must inventory various bleaching clays and select from these a clay which meets the current needs of the processor. Maintaining these inventories is economically undesirable, as is not having a clay suitable for the seasonal content of color impurities.

The spent bleaching clay is saturated with oil and is prone to spontaneous combustion, i.e., the spontaneous development of smoldering sites within the spent clay cake. The onset of smoldering sites is indicated by the development of an acrid odor, then charring of the clay cake, and ultimately fire. This is a common problem that is both undesirable and could be dangerous as well.

The present invention provides a method for the effective bleaching of an oil. Also disclosed is an oil bleaching composition that includes a neutral bleaching clay together with a chelating polycarboxylic acid. This composition also inhibits the spontaneous combustion of the spent bleaching clay. The shortcomings of the aforementioned prior art bleaching methods and compositions are thereby overcome.

SUMMARY OF THE INVENTION

The present invention contemplates a method of bleaching an oil having an undesirable amount of color impurities. The method includes contacting the oil with a specified oil bleaching composition at an elevated temperature and a pressure no greater than atmospheric pressure for a time period sufficient to reduce the amount of color impurities.

The oil bleaching composition includes a neutral bleaching clay containing attapulgite and smectite in a clay composition in combination with a chelating polycarboxylic acid having an even number of carboxyl groups. These carboxyl groups are available to be paired in an eclipsed conformation. The ratio of clay to acid and the amount of oil bleaching composition utilized can be adjusted to compensate for the type of oil to be bleached and for seasonal variations in the amount of color impurities.

Preferably, the amount of attapulgite and smectite in the clay constitutes at least about 65 weight percent of the clay. The attapulgite-to-smectite weight ratio preferably is in the range of about 0.3:1 to about 1.5:1, respectively.

The percent composition exhibits an antioxidant effect and inhibits spontaneous combustion of the bleaching clay after the composition has been used to bleach the oil.

DESCRIPTION OF PREFERRED EMBODIMENTS

Figure 2:
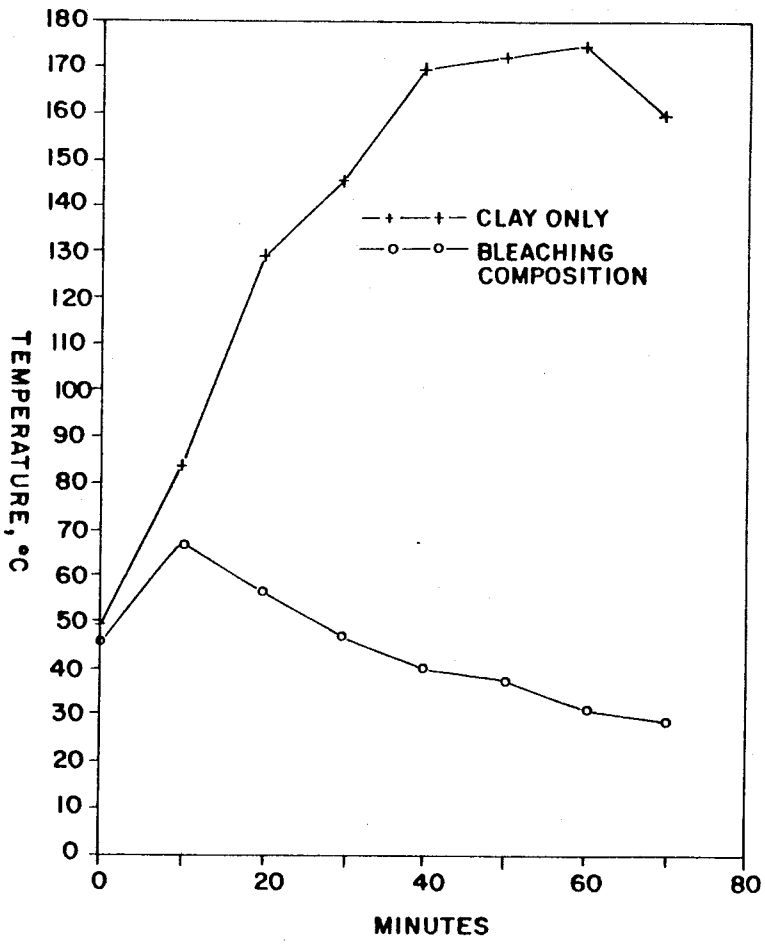
FIG. 2 is a graphical representation of the inhibition of spontaneous combustion of the present bleaching composition as compared to a conventional clay.

While this invention is susceptible to embodiments in many different forms, preferred embodiments of the invention are shown. It should be understood, however, that the present disclosure is to be considered as an exemplification of the principles of the invention and is not intended to limit the invention to the embodiments illustrated.

In the method of the present invention, an oil having color impurities is slurried with neutral clay and a chelating polycarboxylic acid having paired carboxyl groups to obtain an oil having a reduced amount of color impurities.

The oil and the present oil bleaching composition are combined to produce a slurry in a suitable vessel. The oil bleaching composition includes a neutral bleaching clay containing the minerals attapulgite and smectite and a chelating polycarboxylic acid having an even number of carboxyl groups, the carboxyl groups being paired and the carboxyl groups in each pair being available to form an eclipsed conformation. The resulting slurry is maintained at an elevated temperature and at a pressure no greater than atmospheric pressure for a time period sufficient to reduce the amount of color impurities of the oil without causing degrading of the oil, i.e., the oil is bleached without thermal decomposition of the oil. A bleached oil is then recovered from the slurry. A spent oil-containing bleaching composition, that resists spontaneous combustion, is produced.

The temperature at which the present method is performed is above room temperature, i.e., about 30° C., and below the temperature that promotes thermal decomposition of the oil. A preferred temperature is in a range of about 50° to about 130°, more preferably about 60° to about 125° C.

The pressure at which the method is performed can be atmospheric or less than atmospheric (subatmospheric), as desired. A preferred reduced pressure is in a range of about 1 to about 5 inches of mercury. A most preferred reduced pressure is about 4 inches of mercury.

The time period sufficient to reduce the amount of color impurities in the oil usually is in a range of about 5 to about 90 minutes.

Oils that can be bleached by the method and composition of the present invention include both edible and inedible oils. Illustrative oils are those previously mentioned hereinabove.

After filtering the oil, the spent bleaching composition necessarily includes an amount of the oil just bleached. This spent bleaching composition is typically stored for further processing or disposal. Whereas oxidation of the oil in conventional spent bleaching composition is likely to result in auto-ignition, which can also be referred to as spontaneous combustion, the likelihood of spontaneous combustion is substantially reduced if not obviated, in the present compositions.

Clay compositions for use in the present invention are neutral bleaching clays. These clays have a pH value in the range of about 5 to about 9. The pH value is determined from a 5 weight percent slurry of clay in distilled water which is agitated for three minutes prior to measurement of the pH value by a conventional pH meter. Attapulgite and smectite-containing neutral bleaching clays are preferred for the present purposes.

Attapulgite, a mineral found in some clays, is a hydrous silicate material represented by the approximate formula:

$$(OH_2)_4(OH)_2Mg_5Si_8O_{20}4H_2O.$$

See, e.g., Grim, R. E., *Clay Mineralogy*, 2nd ed., McGraw-Hill, Inc., New York, N.Y. (1968), p. 115.

Smectite is a generic term that refers to a variety of related minerals also found in some clays. The smectite minerals typically occur only in extremely small particles. Generally, smectite is believed to be composed of units made of two silica tetrahedral sheets with a central alumina octahedral sheet. Each of the tetrahedra have a tip that points to the center of the smectite unit. The tetrahedral and octahedral sheets are combined so that the tips of the tetrahedrons of each silica sheet and one of the hydroxyl layers of the octahedral sheet form a common layer. See Id., pp. 77–78.

In particular, the smectite family of clays includes the various mineral species montmorillonite, nontronite, hectorite and saponite, all of which can be present in clay in varying amounts.

Other minerals, neither of the smectite genus nor of the attapulgite variety, that can be present in clay include apatite, calcite, the feldspars, kaolinite, mica, quartz and sepiolite.

The mineral compositions of six illustrative clays are present in TABLE I, below.

TABLE I

MINERAL COMPOSITIONS OF VARIOUS CLAYS, PARTS BY WEIGHT

| Sample | attapulgite | smectite | quartz | feldspars | apatite | mica | kaolinite | sepiolite | TOTALS |
|---|---|---|---|---|---|---|---|---|---|
| A | 15 | 50 | 15 | + | + | 5 | 10 | 5 | 100 |
| B | 35 | 45 | 10 | + | + | 3 | 5 | 2 | 100 |
| C | 40 | 50 | 5 | + | + | 3 | 2 | – | 100 |
| D[1] | 50 | 35 | 10 | + | + | 3 | + | 2 | 100 |
| E | 30 | 45 | 10 | + | + | 5 | 10 | + | 100 |
| F[1] | 40 | 40 | 10 | + | + | 5 | 3 | 2 | 100 |

+ Presence detected by X-ray diffraction analysis, but only in minor amount.
[1]Calcite presence detected by X-ray diffraction analysis, but only in minor amounts.

The mineral composition of each of the clay samples identified in TABLE I was obtained employing conventional X-ray diffraction techniques. In particular, the X-ray diffraction data identifying the minerals was obtained from oriented clay films prepared from −2 micron fractions of clay suspensions, i.e., clays having a particle size of less than 2 microns. The clay suspensions were each prepared using distilled water containing a minor amount of an organic dispersant. The clay films representing the −2 micron-size fractions were X-rayed both in an air-dried state and thereafter in an ethylene glycol-saturated state. The quantification of the minerals present was done using the entire sample, not only the −2 micron fraction.

In TABLE II, below, the weight ratio of attapulgite to smectite for each of the six clay samples is listed. Also listed in TABLE II is the weight percent of attapulgite and smectite, taken together, to the total weight of the clay sample. Preferably, the weight ratio of attapulgite to smectite for purposes of the present invention is in the range of about 0.3 to about 1.5. Also, the total amount of attapulgite and smectite, taken together, preferably constitutes at least about 65 weight percent of the clay composition.

TABLE II

RELATIVE AMOUNTS OF ATTAPULGITE AND SMECTITE

| Sample | Weight Ratio Of Attapulgite To Smectite | Amount of Attapulgite And Smectite in Clay Composition, wt-% |
|---|---|---|
| A | 0.30 | 65 |
| B | 0.78 | 80 |
| C | 0.80 | 90 |
| D | 1.43 | 85 |
| E | 0.67 | 75 |
| F | 1.00 | 80 |

The chemical composition of each of the clay samples is listed in TABLE III, below. The various clay composition analyses were obtained employing conventional electron microscopy techniques.

TABLE III

CHEMICAL COMPOSITIONS OF VARIOUS ATTAPULGITE/SMECTITE CLAYS, PARTS BY WEIGHT

| | Sample | | | | | |
|---|---|---|---|---|---|---|
| | A | B | C | D | E | F |
| $SiO_2$ | 58.9 | 54.8 | 54.2 | 56.6 | 56.5 | 54.6 |
| $Al_2O_3$ | 12.3 | 11.7 | 11.5 | 10.5 | 11.0 | 11.7 |
| $Fe_2O_3$ | 4.58 | 4.56 | 3.61 | 2.89 | 3.53 | 4.09 |
| FeO | 0.28 | 0.34 | 0.29 | 0.28 | 0.08 | 0.07 |
| MgO | 3.72 | 4.19 | 5.62 | 6.23 | 5.71 | 5.69 |
| CaO[1] | 0.71 | 0.16 | 0.29 | 0.29 | 0.65 | 0.45 |
| $Na_2O$ | 0.21 | 0.13 | 0.13 | 0.06 | 0.12 | 0.09 |
| $K_2O$ | 1.14 | 1.04 | 0.99 | 0.88 | 0.94 | 0.96 |
| $H_2O^-$ (100° C.) | 8.20 | 13.38 | 12.13 | 12.37 | 11.21 | 12.59 |
| LOI[2] | 15.33 | 20.88 | 21.53 | 21.07 | 19.07 | 20.37 |
| $CaCO_3$[3] | 0.27 | 0.14 | 0.14 | 0.11 | 0.16 | 0.11 |

TABLE III-continued

CHEMICAL COMPOSITIONS OF VARIOUS ATTAPULGITE/SMECTITE CLAYS, PARTS BY WEIGHT

| | Sample | | | | | |
|---|---|---|---|---|---|---|
| | A | B | C | D | E | F |
| Apatite[4] | 1.60 | 1.71 | 1.23 | 0.90 | 1.55 | 1.23 |

[1]CaO values are corrected for any calcite and/or apatite which may be present in the samples, in accordance with commonly accepted $CO_2$-determining and $P_2O_5$-determining analytical practices.
[2]Loss on ignition (LOI) value includes the $H_2O^-$ (100° C.) value from the previous row.
[3]$CaCO_3$ is calcite.
[4]Apatite is a naturally occurring form of calcium phosphate, typically containing minor amounts of fluorine.

The electron microscopy studies of the various attapulgite/smectite clay samples, identified in TABLE III, were performed using a JEM-100 CX analytical electron microscope at 100 kV potential. This electron microscope was provided with an ORTEC EEDS II X-ray analyzer adapted to indicate chemical composition of sub-micron-sized individual clay particles. The chemical composition data was obtained in terms of spectral intensities of characteristic X-ray lines which were subsequently compared to preselected spectral lines of known clay components.

The six attapulgite/smectite clay samples identified in TABLES I to III were used to remove color impurities from soybean oil.

To aliquots of soybean oil (about 100 grams each) was added neutral bleaching clay in an amount sufficient to produce a 1-weight percent suspension of the neutral bleaching clay in soybean oil. The produced clay suspensions were then heated to a temperature of about 115° C. to about 120° C. and maintained at that temperature for a time period of about 5 minutes.

Thereafter the heated clay suspensions were filtered through a Baroid TM filter press using Whatman TM No. 50 filter paper and a nitrogen gas pressure of about 40 psig. Filtration rate was determined by timing the flow of 50 milliliters of the clay-treated oil through the filter press.

Color of the oil before and after treatment was determined by a photometric method [American Oil Chemists Society (A.O.C.S.) Official Method Cc 13c-50, Revised 1981] that was adjusted to accommodate the relatively high green color body content of the oil by making one of the absorbance readings at 710 nanometers (nm) instead of at 670 nm as called for by the Official Method. In addition, a 1 centimeter quartz cell was used for measuring the absorbances. The green color bodies present in the chlorophyll were the color impurities sought to be removed by this experiment.

The amount of chlorophyll present in the oil was determined in accordance with A.O.C.S. Official Method Cc 13d-55.

Also tested in the same manner were clays composed of about 100% smectite and about 100% attapulgite. The latter clays are identified in TABLE IV as samples G and H, respectively. The observed test results are summarized in TABLE IV, below.

TABLE IV

REDUCTION IN OIL[1] COLOR USING CLAY AS BLEACHING AGENT

| Sample | Filtration Rate (ml./min.) | % Oil Absorption | Photometric Color Value | Chlorophyll, p.p.b. | Surface Area[2] $m^2/g$ |
|---|---|---|---|---|---|
| A | 20.4 | 81.6 | 4.0 | 103.3 | 343 |
| B | 19.0 | 104.9 | 4.0 | 78.7 | 301 |
| C | 23.1 | 95.1 | 4.4 | 49.2 | 335 |
| D | 20.7 | 62.2 | 4.5 | 39.4 | 217 |
| E | 22.9 | 70.0 | 4.9 | 54.1 | 296 |
| F | 32.6 | 86.3 | 4.2 | 34.4 | 316 |
| G[3] | 73.2 | 35.9 | 6.9 | 88.6 | 450 |
| H[4] | 23.8 | 79.1 | 6.3 | 226.4 | 154 |

[1]Soybean oil was the oil studied. The oil was bleached at 115-120° C., 5 min., 1% w/w. All clay samples had been oven-dried at 105° C to constant weight.
[2]o-phenanthroline method
[3]G = about 100% smectite
[4]H = about 100% attapulgite The untreated oil had an initial photometric color value of 12.3, which each of the six attapulgite/smectite clay composition samples A to F reduced to an oil color value in the range of about 4 to about 5. Sample G, about 100% smectite, and Sample H, about 100% attapulgite, however, were only able to reduce the oil color value to about 7 and about 6, respectively. Thus, each of the six attapulgite/smectite clay compositions tested was able to more effectively remove color bodies from soybean oil than either the 100% smectite clay or the 100% attapulgite clay, considered individually. The attapulgite/smectite mixture is thus seen to produce a synergistic result.

The six attapulgite/smectite clay composition samples had a filtration rate in the range of about 19 to about 33 milliliters per minute (ml./min.).

The 100% smectite and 100% attapulgite clay samples had filtration rates of about 73 and about 24 ml./min., respectively.

The ability of the clays listed in TABLE IV to remove the chlorophyll color impurity that is present in the soybean oil was another measure used to compare color-removal performance.

The attapulgite/smectite clay composition samples (Samples A to F) were observed to reduce the chlorophyll value of the untreated oil from an initial value of about 635 parts per billion (p.p.b.) to a range of about 39 to about 103 p.p.b.

While the 100% smectite clay sample (Sample G) was also able to reduce the chlorophyll value to about 89 p.p.b., it was only able to reduce the overall color value from 12.3 to 6.9. The 100% attapulgite clay sample (Sample H) was only able to reduce the chlorophyll value to about 226 p.p.b., and, as mentioned above, was only able to reduce the overall color value to 6.3.

Figure 1:
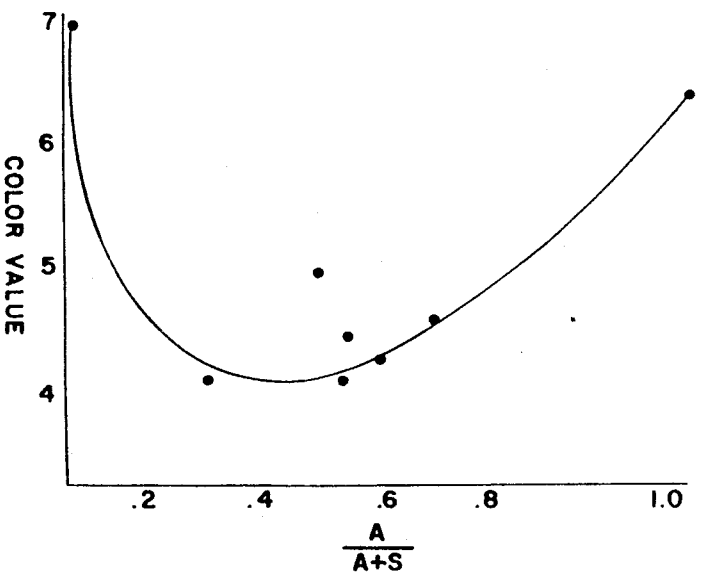
FIG. 1 is a graphical representation of the bleaching efficacy of the clay composition as a function of the attapulgite and smectite content of the clay.

FIG. 1 is a graphical representation of the photometric color value plotted on the ordinate and the ratio of attapulgite-plus-smectite on the abscissa. The data utilized was obtained from TABLES II and IV and is presented in TABLE V wherein "A" and "S" in the column headings stand for attapulgite and smectite, respectively. The improved bleaching efficiency of the neutral bleaching clay is within the range where the attapulgite-to-smectite ratio is 0.3 to 1.5.

TABLE V

COMPARISON OF THE RATIO OF ATTAPULGITE-SMECTITE

| Sample | A/S | A/(A + S) | Color Value |
|---|---|---|---|
| A | 0.3 | 0.230 | 4.0 |
| B | 0.78 | 0.438 | 4.0 |
| C | 0.80 | 0.444 | 4.4 |
| D | 1.43 | 0.588 | 4.5 |
| E | 0.67 | 0.401 | 4.9 |
| F | 1.00 | 0.500 | 4.2 |
| G | 0 | 0 | 6.9 |
| H | ∞ | 1 | 6.3 |

The neutral bleaching clay has a particle size of about 1 micron to about 80 microns. Preferably about 55 to about 95 weight percent of the clay passes through a 325 mesh screen. All mesh screens referred to herein are U.S. Sieve Series mesh screens.

Illustrative suitable neutral bleaching clays include an attapulgite-smectite clay available from Oil-Dri Corporation of America, Chicago, Ill., under the designation Pure-Flo B80 or Pure-Flo F65.

The contemplated chelating acid is a polycarboxylic acid having an even number of carboxyl groups that are paired and each pair is available to be in an eclipsed configuration.

Acids in anhydrous fine granular form or in an aqueous solution are suitable for use in practicing the present invention. The granular form has a particle size whereby about 50 to about 100, preferably about 70 to about 90 weight percent of the acid passes through a 325 mesh screen. The aqueous solution includes about 10 to about 30, preferably about 20 weight percent of the above anhydrous acid based on the total weight of the acid solution.

Illustrative suitable acids include dicarboxylic acids such as malic acid, maleic acid, D-tartaric acid, L-tartaric acid, and mixtures thereof.

The weight ratio of clay to acid in practicing the present method is in a range of about 500:1 to about 10:1, respectively. Preferably this weight ratio is about 25:1.

In use, the bleaching composition constitutes up to about 5 weight percent of the slurry. Preferably the bleaching composition is present in the slurry in a range of about 0.5 to 3.0 weight percent based on the total weight of the oil.

The pH value of the bleaching composition is in the range of about 2.0 to about 6.5, preferably about 3.0 to about 4.0.

The clay and the acid, in any of the above forms, can be added concurrently to the oil to be bleached or the clay can be added to an admixture of the acid, in any of the above forms, and the oil. Alternatively, the acid, in granular form, can be first combined with the clay to form a bleaching composition which is then added to the oil to be bleached. Preferably, the addition of clay does not precede the addition of the acid to the oil.

Seasonal variations in the amount of color impurities as well as variations in color impurities in different oils can be readily compensated for by adjusting the ratio of clay to acid and/or the amount of bleaching composition utilized per unit amount of the oil.

Vessels suitable for use in the present method are capable of maintaining atmospheric and/or a reduced pressure, and are equipped with an agitator, a temperature sensor, a temperature control and, optionally, a nitrogen source and a vacuum pump source if a reduced pressure is utilized.

Experiments were performed to determine the utility of the present invention, the results of which are presented in TABLE VI, below. The apparatus utilized included a 500 ml 3-neck distilling flask as the vessel, two flow control adapters, a Wheaton adapter, a thermometer, an Electromantle MA heater/magnetic stirrer available from Electrothermal, Inc., Gillette, N.J., a Gast rotary vacuum pump available from Gast Manufacturing Corporation, Benton Harbor, Mich. and a high purity nitrogen source.

In the bleaching method the desired amount of oil (100 grams) was weighed and introduced into the vessel. An alkali-refined soybean oil was the oil utilized in the following experiments. Agitation by the magnetic stirrer was initiated and maintained until completion of the experiment. The flask was then sealed and evacuated to a pressure of about 4 inches of mercury. The temperature of the contents of the flask was then elevated to about 60° C. in a relatively short time period, e.g., about 1 to about 2 minutes, and maintained at this temperature for a time period of about two minutes. The reduced pressure was then broken by the introduction of nitrogen. The previously measured desired amount of clay or oil bleaching composition was then introduced into the flask. The flask was again sealed and evacuated to a pressure of about 4 inches of mercury. The temperature of the contents was elevated to about 120° C. in a relatively short time period, e.g., about 3.5 to about 4.5 minutes, and maintained at this temperature for a time period of about 30 minutes. The contents were then cooled to a temperature of about 60° C. in a relatively short time period, e.g., about 2 to about 4 minutes. The reduced pressure was then broken by the introduction of nitrogen. The resulting oil/clay slurry was filtered by a Baroid filter press, available from Baroid Division, N.L. Industries, Houston, Tex., equipped with Whatman No. 50 filter paper, available from Baroid Division, and filtered with 40 pounds per square inch gauge (psig) of nitrogen pressure to recover an oil having a reduced amount of color impurities.

The chlorophyll levels and color of the oil where determined using the Revised 1980 American Oil Chemists' Society (AOCS) Official Methods Cc 13d-55 and Cc 13b-45, respectively.

The clay utilized was a neutral bleaching clay containing attapulgite and smectite, and commercially available from Oil-Dri Corporation of America, Chicago, Ill. under the designation Pure-Flo B80. This clay had a particle size whereby 89.2% of the particles passed through a 325 mesh.

Both aqueous and anhydrous fine granular forms of the acids were utilized. The aqueous solutions include 20 weight percent anhydrous acid based on the total weight of the acid solution. The granular forms had a particle size whereby 75 weight percent of the particle passed through a 325 mesh screen.

In TABLE VI, below, the weight percent of acid in neutral bleaching clay was maintained at a constant 4 weight percent based on the total weight of the clay and anhydrous acid. The acid in dry form and clay were admixed prior to introduction into the vessel. The aqueous solution was first added to the oil, and the resulting admixture was then combined with the clay.

The initial chlorophyll content was 752 parts per billion parts of oil (PPB) and the initial color value was 9.2.

TABLE VI

CHLOROPHYLL AND COLOR LEVELS FOR ONCE REFINED SOYBEAN OIL AFTER BLEACHING

| Amount of clay or clay and acid added (weight percent) | Acid (Form) | Chlorophyll (PPB)[1] | Color (Red) |
|---|---|---|---|
| 0.5 | — | 148.7 | 3.5 |
| 1.5 | — | 33.7 | 2.5 |
| 0.5 | Maleic Acid (gran)[2] | 71.8 | 3.5 |
| 1.5 | Maleic Acid (gran) | 0 | 1.7 |
| 0.5 | Maleic Acid (20% Aq)[3] | 83.7 | 3.7 |
| 1.5 | Maleic Acid (20% Aq) | 0 | 1.4 |
| 0.5 | Malic Acid (gran) | 70.9 | 3.4 |
| 1.5 | Malic Acid (gran) | 4.9 | 1.7 |
| 0.5 | Malic Acid (20% Aq) | 70.1 | 3.5 |
| 1.5 | Malic Acid (20% Aq) | 4.3 | 1.7 |
| 0.5 | D-Tartaric Acid (gran) | 142.3 | 3.6 |
| 1.5 | D-Tartaric Acid (gran) | 21.3 | 2.0 |
| 0.5 | D-Tartaric Acid (20% Aq) | 78.9 | 3.5 |
| 1.5 | D-Tartaric Acid (20% Aq) | 4.9 | 1.8 |
| 0.5 | Phosphoric Acid (Conc.)[4] | 94.4 | 3.4 |
| 1.5 | Phosphoric Acid (Conc.) | 24.6 | 2.4 |
| 0.5 | Phosphoric Acid (20% Aq) | 93.3 | 3.8 |
| 1.5 | Phosphoric Acid (20% Aq) | 22.2 | 1.9 |
| 0.5 | Fumaric Acid[5] (gran) | 109.1 | 3.1 |
| 1.5 | Fumaric Acid (gran) | 21.3 | 1.8 |
| 0.5 | Gluconic Acid[6] (20% Aq) | 149.7 | 3.8 |
| 1.5 | Gluconic Acid (20% Aq) | 28.1 | 2.3 |
| 0.5 | Acetic Acid (Conc.) | 131.9 | 3.4 |
| 1.5 | Acetic Acid (Conc.) | 6.6 | 1.6 |
| 0.5 | Silica 300[7] | 134.5 | 3.2 |
| 1.5 | Silica 300 | 32.0 | 2.2 |

[1]Parts per billion.
[2]Anhydrous fine granular form.
[3]20 Weight percent anhydrous in an aqueous solution.
[4]Concentrated.
[5]Fumaric acid is not soluble in water.
[6]Gluconic acid was supplied as a 50% aqueous solution.
[7]Silica 300 is acid treated silica available from W. R. Grace & Co., Baltimore, Maryland, U.S.A.

The above data clearly demonstrates the superior oil bleaching performance of malic acid, maleic acid and tartaric acid in combination with a neutral clay.

A combustion study was conducted to demonstrate the antioxidant effect of the present composition and is presented hereinbelow.

A cake of spent clay was obtained by admixing in a suitable vessel 270 grams of once refined soybean oil with 70 grams of neutral bleaching clay or the present bleaching composition. The neutral bleaching clay used was an attapulgite-smectite clay, Pure-Flo B80, commercially available from Oil-Dri Corp. The bleaching composition comprised Pure-Flo B80 and 4 weight percent malic acid, based on the weight of the clay.

Oil treatment was conducted at atmospheric pressure and a temperature of about 120° C. for a time period of about 5 minutes.

Each oil containing admixture was filtered on a Baroid press, discussed previously, in a filter cup preheated to a temperature of about 135° C. with 75 psi nitrogen pressure.

When the bulk of the oil containing admixture had been filtered, the press was purged with the nitrogen for an additional 5 minutes.

After purging, the resulting filter cake (about 90–100 grams) was removed from the filter cup and minced for 5 seconds. The filter cake contained about 25 to about 30 weight percent oil.

The minced filter cake was aerated for about 20 seconds in a sealable container preheated to about 135° C. That is, the minced filter cake was placed in the container which was then sealed and hand shaken.

Next, the aerated and minced filter cake was placed in a clay crucible preheated to about 135° C., and thermometers were inserted into the minced filter cake. Spontaneous combustion of the clay occurred when the temperature in the upper 2 centimeters of the minced filter cake reached about 100° C.

The highest temperature obtained for each of the six test runs for a particular time is presented in TABLE VII.

TABLE VII

COMBUSTION STUDY RESULT

| Time | Bleaching Composition[1] | | | | | Clay[2] | | |
|---|---|---|---|---|---|---|---|---|
| (minutes) | Run 1 | Run 2 | Run 3 | Run 4 | Average[3] | Run 1 | Run 2 | Average[3] |
| 0 | 44 | 44 | 52 | 40 | 45.3 | 53 | 45 | 49.0 |
| 10 | 63 | 70 | 73 | 59 | 67.3 | 72 | 96 | 84.0 |
| 20 | 53 | 58 | 62 | 49 | 56.3 | 125 | 133 | 129.0 |
| 30 | 55 | 48 | 49 | 43 | 46.7 | 147 | 145 | 146.0 |
| 40 | 69 | 42 | 40 | 38 | 40.0 | 174 | 166 | 170.0 |
| 50 | 82 | 42 | 35 | 36 | 37.7 | 174 | 171 | 172.5 |
| 60 | 90 | 32 | 31 | 30 | 31.0 | 195 | 155 | 175.0 |
| 70 | 105 | 30 | 29 | 28 | 29.0 | 185 | 135 | 160.0 |
| 80 | 120 | — | — | — | — | — | — | — |
| 90 | 118 | — | — | — | — | — | — | — |
| 100 | 110 | — | — | — | — | — | — | — |
| 110 | 91 | — | — | — | — | — | — | — |
| 120 | 74 | — | — | — | — | — | — | — |
| 130 | 60 | — | — | — | — | — | — | — |
| 140 | 50 | — | — | — | — | — | — | — |

[1]Bleaching composition comprised Pure-Flo B80, from Oil-Dri Corp. and 4 weight percent malic acid, based on the weight of the clay.
[2]Pure Pure-Flo B80 from Oil-Dri Corp.
[3]Average of Runs 2, 3 and 4.

Spontaneous combustion was observed in both clay runs but in only one of four clay-plus-acid runs.

Only one of the clay-plus-acid runs reached a temperature above 100° C. and charred spontaneously. It is believed that this was due to non-uniform distribution of acid within the spent clay cake.

The above data shows that even after 60 minutes the clay-plus-acid bleaching composition had not yet reached the auto-ignition temperature of about 100° C. In contrast, both of the acid-free clay runs already exceeded that temperature in 20 minutes. Thus, even the first run of the spent bleaching composition exhibited oxidation inhibition although it did not prohibit oxidation and spontaneous combustion.

Furthermore, the highest temperature of the first run of the bleaching composition was 120° C. In contradistinction, the two clay runs that did not contain malic acid reached temperatures of 195° C. and 171° C., respectively. This also indicates inhibition of oxidation by the clay-plus-acid bleaching composition.

The remaining clay-plus-acid bleaching composition runs did not auto-ignite. However, the contents of these crucibles did exhibit a typical pre-charring color in numerous spots when examined. This indicates that the combustion reaction had initiated but did not propagate.

FIG. 2 is a graphical representation of the temperature (° C.) plotted on the ordinate and the elapsed time (minutes) on the abscissa of the average temperature, as a function of time, of the two clay-only runs (+) of TABLE VII as compared to the temperature, as a function of time, of the averaged three bleaching composition runs (o) of TABLE VII. This Figure emphasizes the improvement obtained in inhibiting spontaneous combustion using the present bleaching composition as compared to a conventional clay.

This invention has been described in terms of specific embodiments set forth in detail. It should be understood, however, that these embodiments are presented by way of illustration only, and that the invention is not necessarily limited thereto. Modifications and variations within the spirit and scope of the claims that follow will be readily apparent from this disclosure, as those skilled in the art will appreciate.

We claim:

1. A triglyceride oil bleaching composition suitable for removing color impurities from a triglyceride oil, the composition consisting essentially of an admixture of:

a neutral bleaching clay comprising an attapulgite-smectite clay composition in which the attapulgite-to-smectite weight ratio is in the range of about 0.3:1 to about 1.5:1, and the total weight of attapulgite and smectite is at least 65 weight percent of the clay composition; and a chelating polycarboxylic acid having an even number of carboxyl groups, said carboxyl groups being paired, and the carboxyl groups in each pair being available to form an eclipsed configuration.

2. The composition in accordance with claim 1 wherein the clay and the acid are present in a weight ratio in the range of about 500:1 to about 10:1, respectively.

3. The composition in accordance with claim 1 wherein the clay and the acid are present in a weight ratio of about 25:1, respectively.

4. The composition in accordance with claim 1 wherein the acid is an aqueous acid solution.

5. The composition in accordance with claim 1 wherein the acid is in anhydrous fine granular form.

6. The composition in accordance with claim 1 wherein the acid is a member of the group consisting of malic acid, maleic acid, D-tartaric acid, L-tartaric acid, and mixtures thereof.

* * * * *